US005505034A

United States Patent [19]

Dueck

[11] Patent Number: 5,505,034

[45] Date of Patent: Apr. 9, 1996

[54] RETAINING WALL BLOCK

[75] Inventor: Vernon J. Dueck, Burnaby, Canada

[73] Assignee: Pacific Pre-Cast Products, Ltd., Burnaby, Canada

[21] Appl. No.: 146,278

[22] Filed: Nov. 2, 1993

[51] Int. Cl.[6] ..... E04C 1/00

[52] U.S. Cl. ..... 52/604; 52/603; 52/596; 52/592.6; 52/589.1; 405/286

[58] Field of Search ..... 52/169.4, 604–609, 52/596, 592.6, 589.1; 405/284, 286, 262, 272

[56] References Cited

U.S. PATENT DOCUMENTS

| | | | |
|---|---|---|---|
| 2,892,340 | 6/1959 | Fort . | |
| 3,888,060 | 6/1975 | Haener | 52/592.4 |
| 4,083,190 | 4/1978 | Pey | 52/608 X |
| 4,107,894 | 8/1978 | Mullins | 52/592.6 |
| 4,229,123 | 10/1980 | Heinzmann | 52/608 X |
| 4,372,091 | 2/1983 | Brown et al. | 52/604 |
| 4,671,706 | 6/1987 | Giardini | 405/286 |
| 4,825,619 | 5/1989 | Forsberg | 52/562 |
| 4,860,505 | 8/1989 | Bender | 52/98 |
| 4,896,472 | 1/1990 | Hunt | 52/592.6 |
| 4,920,712 | 5/1990 | Dean | 52/169.4 |
| 4,964,761 | 10/1990 | Rossi | 405/286 |
| 4,965,979 | 10/1990 | Larrivee | 52/606 X |
| 5,017,049 | 5/1991 | Sievert | 405/286 |
| 5,044,834 | 9/1991 | Janopaul | 405/284 |
| 5,161,918 | 11/1992 | Hodel | 52/606 X |

FOREIGN PATENT DOCUMENTS

| | | | |
|---|---|---|---|
| 0013535 | 7/1980 | European Pat. Off. . | |
| 0488917 | 11/1918 | France | 52/592.6 |

*Primary Examiner*—Carl D. Friedman
*Assistant Examiner*—Winnie S. Yip
*Attorney, Agent, or Firm*—Townsend and Townsend and Crew

[57] ABSTRACT

A block for forming a retaining wall comprising a generally parallelepiped body with front, rear, top, bottom and side surfaces and a central internal cavity with internal walls. Integrally formed protruding knobs are formed on the bottom surface adjacent the front surface and are positioned for protruding into the central cavity of at least one other block in a wall formed from the blocks. The protruding knobs are adapted to abut the internal walls of the open cavity to position the block in the retaining wall. A wall construction using the blocks is provided.

17 Claims, 4 Drawing Sheets

RETAINING WALL BLOCK

FIELD OF THE INVENTION

This invention relates to a building block and a block wall construction.

BACKGROUND OF THE INVENTION

Retaining walls to prevent earth embankments from sliding and slumping are well known. Conventional walls are constructed from materials such as wood ties or blocks of stone or concrete. The rows of a wall are often offset with respect to one another to form a wall face that is inclined with respect to the vertical.

Retaining walls formed from interconnectable blocks are particularly popular as they are sturdy and relatively easy to construct. Many block designs and wall configurations have been developed. Examples of such designs are shown in the following patents:

U.S. Pat. 2,892,340 to Fort

U.S. Pat. 4,671,706 to Giardini

U.S. Pat. 4,825,619 to Forsberg

U.S. Pat. 4,860,505 to Bender

U.S. Pat. 4,920,712 to Dean, Jr.

U.S. Pat. 4,964,761 to Rossi

U.S. Pat. 4,965,979 to Larrivee et al.

U.S. Pat. 5,017,049 to Sievert

U.S. Pat. 5,044,834 to Janopaul, Jr.

U.S. Pat. 5,161,918 to Hodel

The wall blocks and wall constructions disclosed in the foregoing patents generally relate to blocks that use a system of drilled holes and aligning pegs or a tongue and groove arrangement to position and interlock together the individual blocks of the retaining wall.

Tongue and groove interlocking blocks suffer from the disadvantage that they are difficult if not impossible to form into a curved configuration without using specially shaped blocks. It is often necessary to have a curve in a retaining wall to accommodate curves in the terrain.

Blocks that use drilled holes and aligning pegs tend to be time consuming to interfit together. The additional cost of the aligning pegs and specially drilled holes in blocks makes the blocks more expensive to manufacture. The result is a retaining wall that is costlier to construct in terms of both time and materials.

SUMMARY OF THE INVENTION

The present invention provides a wall block that addresses the foregoing disadvantages of the prior art. The wall blocks of the present invention can be quickly and efficiently assembled into a straight or curved retaining wall using a single block design.

Accordingly, the present invention provides a block for forming a retaining wall comprising:

a generally parallelepiped body with front, rear, top, bottom and side surfaces and a central internal cavity with internal walls;

projecting means integrally formed on the bottom surface adjacent the front surface and positioned for protruding into the central cavity of at least one other block in a wall formed from the blocks, the projecting means being engagable against the internal walls of the open cavity to position the block in the retaining wall.

In a further aspect, the present invention provides a retaining wall comprising:

a lower tier of individual blocks arranged side by side, each block having a body with an internal cavity having internal walls;

an upper tier of individual blocks arranged side by side, each block having integrally formed projecting means formed on a lower surface of the block;

the upper tier being positioned on top of the lower tier with the projecting means of the upper tier being inserted within corresponding internal cavities of the lower tier to abut an internal wall of the cavities thereby positioning the blocks of the upper and lower tiers with respect to each other, the projecting means and the internal cavity being dimensioned and positioned such that the blocks of the upper tier are offset rearwardly and laterally from the blocks of the lower tier.

BRIEF DESCRIPTION OF THE DRAWINGS

Aspects of the present invention are illustrated, merely by way of example, in the accompanying drawings, in which.

DESCRIPTION OF THE PREFERRED EMBODIMENTS

Figure 1:
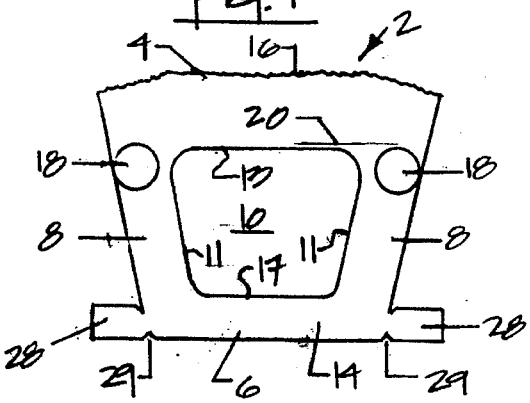
FIG. 1 is a plan view of a block according to the present invention.
Figure 2:
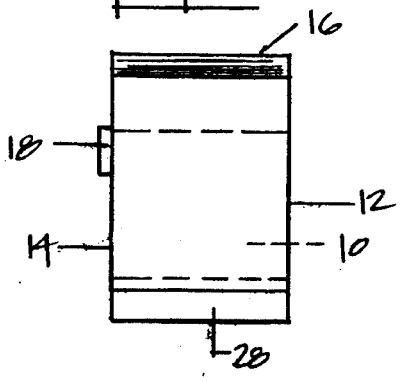
FIG. 2 is a side elevation view of the block of FIG. 1.
Figure 5:
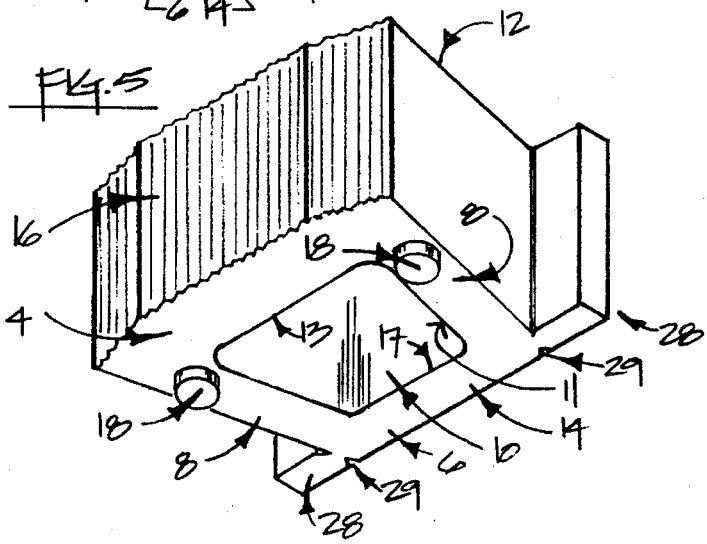
FIG. 5 is a perspective view of the block of FIG. 1 and 2.

FIGS. 1, 2 and 5 illustrate a first embodiment of a block 2 for forming a retaining wall. The block includes spaced front and rear wall portions 4 and 6, respectively. A pair of sidewalls 8 extend between and join the front and rear wall portions to define a central open cavity 10 through the block having internal side walls 11, internal front wall 13 and internal rear wall 17. The block has an upper surface 12 and a lower surface 14.

The block is preferably formed from concrete and the face of front wall portion 4 is formed with a roughened pattern 16. The block has a generally trapezoidal shape in plan view with the front wall portion 4 wider than the rear wall portion 6.

Figure 3:
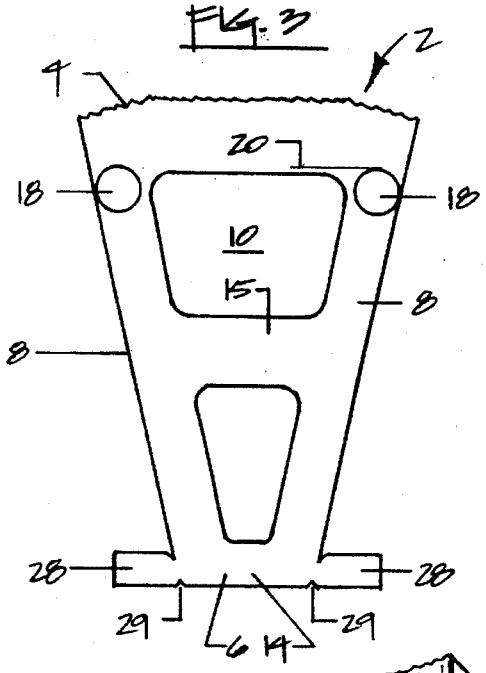
FIG. 3 is a plan view of a second embodiment of the block of the present invention.
Figure 4:
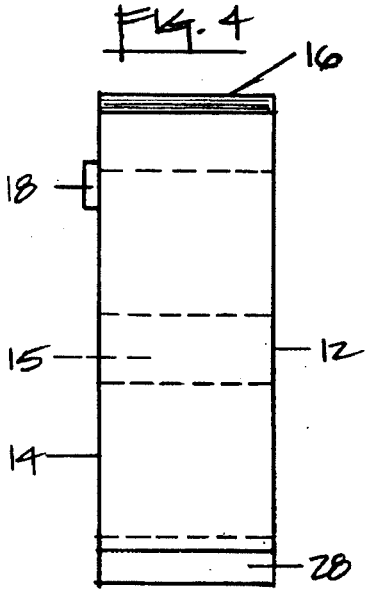
FIG. 4 is a side elevation view of the block of FIG. 3.

FIGS. 3 and 4 illustrate a second embodiment of the block having a greater overall length than the first embodiment. A reinforcing web 15 is provided between the sidewalls 8 at substantially mid-length along the sidewalls. An internal cavity 10 is formed between web 15 and the front wall portion 4. The blocks of FIGS. 3 and 4 are used in larger retaining walls as their additional size and mass allows them to support a greater bulk of soil.

The blocks of the present invention are filled with loose angular gravel and dirt poured into open cavities 10 once the blocks are assembled into a wall structure to anchor the wall in place. The gravel or dirt permits free drainage of water through the interior of the wall.

Figure 6:
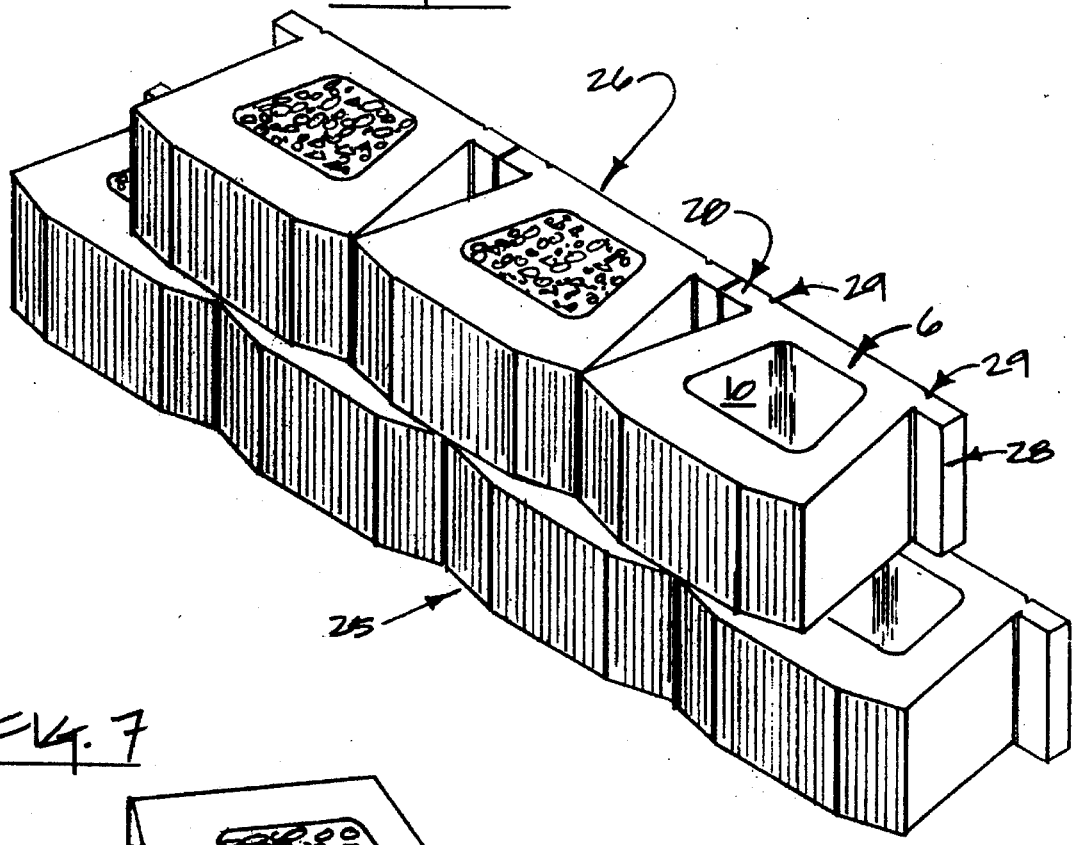
FIG. 6 is a perspective view of a straight retaining wall constructed using the blocks of FIG. 1 and 2.
Figure 7:
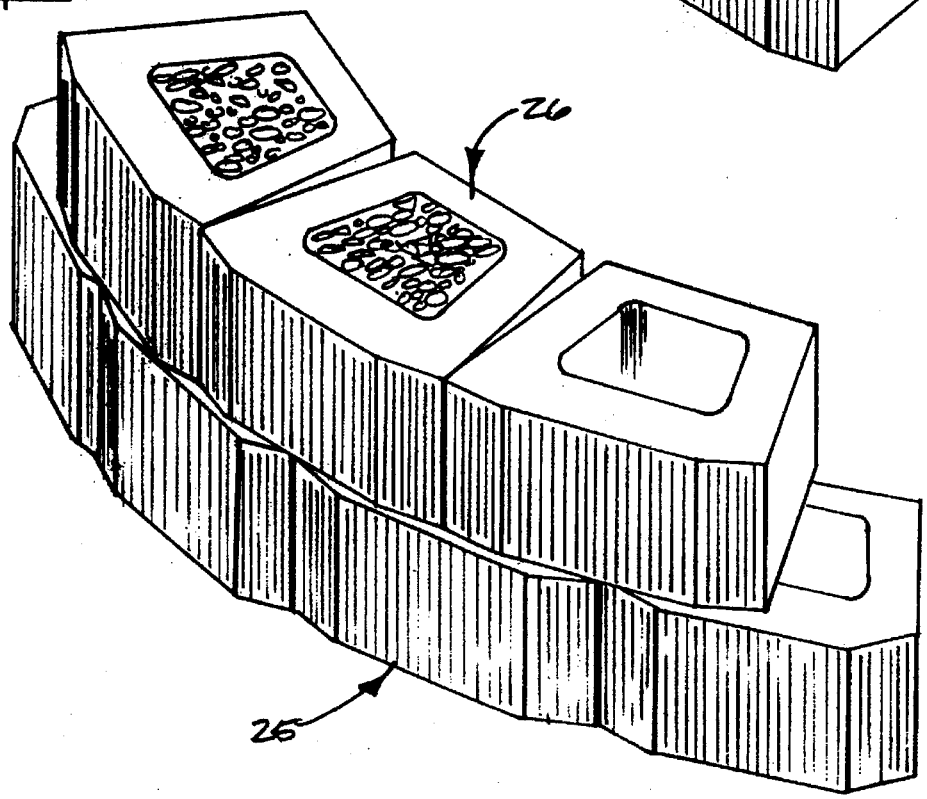
FIG. 7 is a perspective view of a curved retaining wall constructed using the blocks of FIG. 1.

Both embodiments of the block are provided with projecting means in the form of a pair of spaced, cylindrical extensions or knobs 18. Knobs 18 are integrally formed on the lower surface 14 of sidewalls 8 adjacent front wall portion 4. Knobs 18 are positioned on lower surface 14 to protrude into the open cavity 10 of an underlying block when the blocks are stacked atop each other to form a retaining wall as illustrated in FIGS. 6 and 7. Knobs 18 of an upper block are abutted against an internal side wall 11 and internal front wall 13 of a cavity 10 in a lower block to quickly position the blocks in a wall structure. Knobs 18 extend slightly ahead of cavity 10 by a distance 20 such that the front wall portion 4 of an upper block is offset rearwardly from the front wall portion of an underlying block when the blocks are stacked one atop the other. This is the case even when knob 18 is directly engaging internal front wall 13. This offset distance can be increased by moving knob 18 toward internal rear wall 17. In addition, it is necessary to laterally offset or stagger an upper block to stack it atop a pair of underlying blocks. This staggered block arrangement permits each knob 8 of the upper block to fit within the cavities 10 of two underlying blocks.

FIG. 6 illustrates a retaining wall constructed with the blocks of FIGS. 1, 2 and 5. A lower tier 25 of individual blocks 2 are arranged side by side. An upper tier 26 of blocks is positioned on top of lower tier 25 such that knobs 18 of the upper tier are inserted within corresponding internal cavities 10 of the lower tier to abut an internal wall 11 of the cavities thereby positioning the blocks of the upper and lower tiers with respect to each other. The blocks of the upper tier are offset rearwardly and laterally from the blocks of the lower tier.

A retaining wall constructed according to the foregoing description is formed from identical blocks 2. The blocks can be arranged in a straight line as illustrated in FIG. 6. FIG. 7 illustrates a retaining wall in which the blocks are arranged in an arcuate configuration. Rear wall portion 6 of the block includes frangible extensions 28 that extend beyond sidewalls 8. Frangible extensions 28 can be broken off along pre-formed fault lines 29 so that each block is reduced to essentially an arcuate segment. Each block can then be rotated to a desired angle to form a curved retaining wall as shown in FIG. 7. The rounded surface of knobs 18 accommodate any curve in the retaining wall while maintaining consistent rearward and lateral offset in relation to other blocks.

Figure 8:
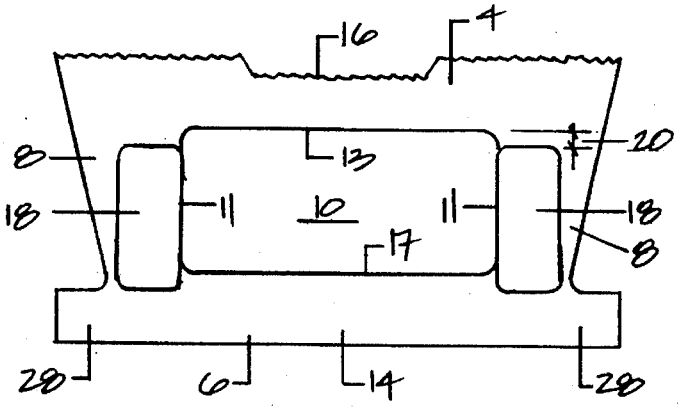
FIG. 8 is a plan view of a third embodiment of the block of the present invention.
Figure 9:
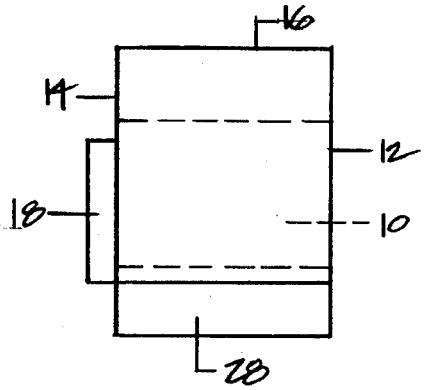
FIG. 9 is a side elevation view of the block of FIG. 8.

FIGS. 8 and 9 illustrate a third embodiment of the block of the present invention intended for forming straight retaining walls. The block of FIGS. 8 and 9 is formed with essentially rectangular knobs 18 that are dimensioned for a close fit between the front and rear walls 13 and 17, respectively, of an essentially rectangular internal cavity 10 of another block. Rectangular knobs 18 are offset rearwardly from front wall portion 4 and behind the front wall 13 of internal cavity 10 unlike in the blocks of FIGS. 1 to 4 where knobs 18 extend forwardly of the cavity front wall. The result is that the blocks of FIG. 8 and 9 must be oriented such that the knobs 18 are on the uppermost surface in order to construct a wall that is inclined at an angle to the vertical into the material to be held back by the wall. This arrangement is preferred as it allows the user to see knobs 18 of a lower block when aligning an upper block cavity 10 over the close fitting knobs. Knobs 18 permit lateral adjustment of the blocks with respect to each other, however, forward or rearward movement of individual blocks is prevented.

Figure 10:
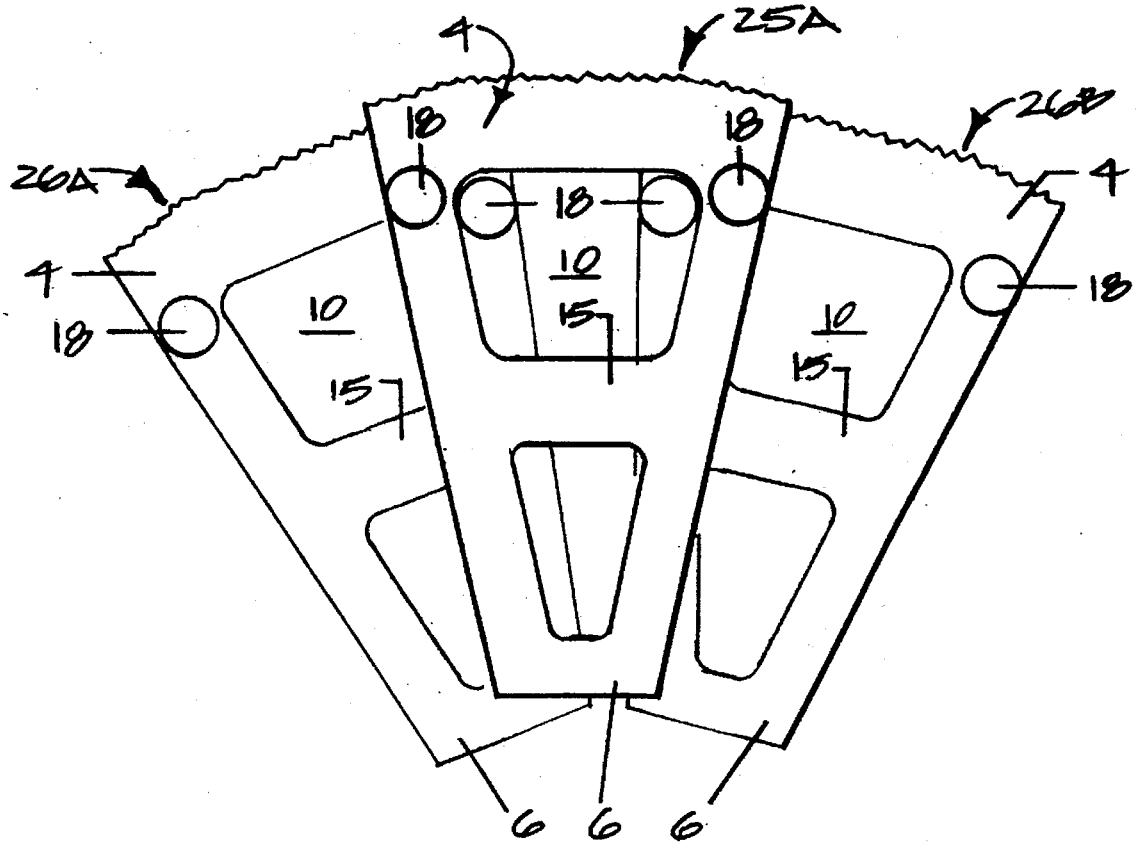
FIG. 10 is a plan view of a section of a wall constructed from the blocks of FIG. 3.

FIG. 10 illustrates a plan section of a wall constructed from blocks of the embodiment illustrated in FIG. 3. The projecting means 18 of upper tier blocks **26*a* and 26*b* are engageable against the internal walls of open cavity 10 of lower tier block 25*a*, where all frangible extensions 28** have been broken off.

Although the present invention has been described in some detail by way of example for purposes of clarity and understanding, it will be apparent that certain changes and modifications may be practised within the scope of the appended claims.

I claim:

1. A block for forming a retaining wall comprising:

a body with front, rear, top, bottom and side surfaces and a central cavity with internal walls;

projecting means integrally formed on the bottom surface adjacent the front surface and positioned for protruding into the central cavity of at least one other underlying block in a wall formed from the blocks, the projecting means being laterally offset from the cavity and forwardly offset by a distance from the cavity toward the front surface and having a rounded surface being engageable against the internal walls of the cavity of an underlying block to position the block in the retaining wall in offset relation to underlying blocks.

2. A block for forming a retaining wall comprising:

spaced front and rear wall portions;

a pair of sidewalls extending between and joining the front and rear wall portions to define a central cavity in the block, the cavity having internal walls;

the block having an upper surface and a lower surface;

projecting means integrally formed on the side walls adjacent the front wall portion and positioned for protruding into the central cavity of at least one other underlying block in a wall formed from the blocks, the projecting means being laterally offset from the cavity and forwardly offset by a distance from the central cavity toward the front wall portion and having one rounded surface being engageable against the internal walls of the cavity in an underlying block to position the block in offset relation to underlying blocks.

3. A block as claimed in claim 2 in which the block comprises a generally trapezoidal shape in plan view with the front wall portion wider than the rear wall portion and the pair of sidewalls extending therebetween.

4. A block as claimed in claim 3 in which the rear wall portion is formed with frangible extensions that extend beyond the side walls.

5. A block as claimed in claim 2 in which the projection means are positioned with respect to the sidewalls and the internal cavity such that the block is laterally offset in relation to an underlying block.

6. A retaining wall comprising;

a lower tier of individual blocks arranged side by side, each block of the lower tier having a body with an cavity having internal walls;

an upper tier of individual blocks arranged side by side, each block of the upper tier having a body with front, rear, and side surfaces and an cavity and having projecting means with one rounded surface being integrally formed on a lower surface of the upper tier block, the projecting means being laterally offset from the cavity and forwardly offset by a distance from the cavity toward the front surface;

the upper tier blocks being positioned on top of the lower tier blocks with the projecting means of the upper tier being inserted within corresponding cavities, of the lower tier to abut an internal wall of the cavities, with projecting means of adjacent blocks of the upper tier being inserted into the same cavity of a block in the lower tier, thereby positioning the blocks of the upper and lower tiers with respect to each other, the projecting means and the cavity being dimensioned and positioned such that the blocks of the upper tier are offset rearwardly and laterally from the blocks of the lower tier.

7. A retaining wall as claimed in claim 6, wherein the internal cavities are filled with granular fill.

8. A retaining wall as claimed in claim 6 in which all the blocks are identical.

9. A retaining wall as claimed in claim 8, wherein the internal cavities are filled with granular fill.

10. A retaining walls as claimed in claim 6 in which the tiers are arranged in a straight configuration.

11. A retaining wall as claimed in claim 10, wherein the internal cavities are filled with granular fill.

12. A retaining wall as claimed in claim 6 in which the tiers are arranged in an arcuate configuration.

13. A retaining wall as claimed in claim 12, wherein the internal cavities are filled with granular fill.

14. A retaining wall as claimed in claim 6, in which said projecting means of each block of the upper tier is formed with a pair of extensions having a rounded surface, each extension being engaged within the cavity of a separate underlying block.

15. A retaining wall as claimed in claim 14, wherein the internal cavities are filled with granular fill.

16. A block for forming a retaining wall comprising:

spaced front and rear wall portions;

a pair of sidewalls extending between and joining the front and rear wall portions to define a central cavity in the block, the cavity having internal walls;

the block having an upper surface and a lower surface;

projecting means integrally formed on the side walls adjacent the front wall portion and positioned for protruding into the central cavity of at least one other underlying block in a wall formed from the blocks, the projecting means having one rounded surface and being engageable against the internal walls of the cavity in an underlying block to position the block in offset relation to underlying blocks, in which the projection means comprise a pair of cylindrical extensions formed on the lower surface of the block adjacent each sidewall.

17. The block of claim 16, wherein the projection means are positioned with respect to the sidewalls and the internal cavity such that the front wall portion of the block is offset rearwardly from the front wall portion of an underlying block.

* * * * *